US009695017B2

(12) United States Patent
Zhu et al.

(10) Patent No.: US 9,695,017 B2
(45) Date of Patent: Jul. 4, 2017

(54) ADJUSTABLE INTERMEDIATE DISK BODY OF LARGE DOUBLE-LAYER CAGE AND ADJUSTING AND MOVING METHOD THEREOF

(71) Applicants: China University of Mining and Technology, Xuzhou (CN); Xuzhou Coal Mine Safety Equipment Manufacture Co., Ltd., Xuzhou (CN)

(72) Inventors: Zhencai Zhu, Xuzhou (CN); Gongbo Zhou, Xuzhou (CN); Changhua Hu, Xuzhou (CN); Guohua Cao, Xuzhou (CN); Wei Li, Xuzhou (CN); Guoan Chen, Xuzhou (CN); Yuxing Peng, Xuzhou (CN); Qingyong Du, Xuzhou (CN); Zhi Liu, Xuzhou (CN)

(73) Assignees: China University of Mining and Technology, Xuzhou, JS (CN); Xuzhou Coal Mine Safety Equipment Manufacture Co., Ltd., Xuzhou, JS (CN)

( * ) Notice: Subject to any disclaimer, the term of this patent is extended or adjusted under 35 U.S.C. 154(b) by 0 days.

(21) Appl. No.: 14/441,550

(22) PCT Filed: Mar. 26, 2014

(86) PCT No.: PCT/CN2014/074087

§ 371 (c)(1),
(2) Date: May 8, 2015

(87) PCT Pub. No.: WO2015/043145

PCT Pub. Date: Apr. 2, 2015

(65) Prior Publication Data

US 2016/0207740 A1 Jul. 21, 2016

(30) Foreign Application Priority Data

Sep. 29, 2013 (CN) ..... 2013 1 0453547

(51) Int. Cl.
*B66B 17/04* (2006.01)

(52) U.S. Cl.
CPC ..... *B66B 17/04* (2013.01)

(58) Field of Classification Search
CPC ..... B66B 17/04
(Continued)

(56) References Cited

U.S. PATENT DOCUMENTS 5,370,207 A * 12/1994 Hongo ..... B66B 5/22 187/343
5,450,929 A * 9/1995 Ohgita ..... B66F 9/07 187/244

(Continued)

FOREIGN PATENT DOCUMENTS

CN 201485157 5/2010
CN 201567134 9/2010

(Continued)

OTHER PUBLICATIONS

International Search Report re PCT/CN2014/074087, date of mailing Jun. 24, 2014, 5 pgs.

*Primary Examiner* — Michael Riegelman
(74) *Attorney, Agent, or Firm* — Greenberg Traurig, LLP

(57) ABSTRACT

An adjustable intermediate disk body of large double-layer cage comprises cage columns, a main intermediate disk body, and a chain block and a connecting piece. An intermediate disk guide rail beam is arranged on the inner side of the cage columns, wedge bases are symmetrically arranged on the two sides of the lower part of the intermediate disk guide rail beam, a limited block with a bolt hole is arranged on the upper part of the intermediate disk guide rail beam, and an anti-disengaging plate is arranged on the intermediate disk guide rail beam. Intermediate disk wedge bodies, which match the wedge faces of the wedge bases and can only move vertically along the intermediate disk guide rail beams, are arranged on the two side faces of the main intermediate disk body, at positions corresponding to the (Continued)

intermediate disk guide rail beams; an intermediate disk guide wheel that is fitted with the intermediate disk guide rail beam and an intermediate disk guide wheel seat with a bolt hole are arranged on the upper part of the intermediate disk wedge body.

3 Claims, 4 Drawing Sheets

(58) Field of Classification Search
USPC ..... 187/401
See application file for complete search history.

(56) References Cited

U.S. PATENT DOCUMENTS

| | | | | |
|---|---|---|---|---|
| 2013/0233654 | A1* | 9/2013 | Cao | B66B 7/025 187/407 |
| 2014/0110194 | A1* | 4/2014 | Zhu | B66B 7/08 187/254 |
| 2015/0291391 | A1* | 10/2015 | Zhu | B66B 5/28 187/347 |
| 2015/0329326 | A1* | 11/2015 | Mittermayr | B66B 13/12 187/330 |

FOREIGN PATENT DOCUMENTS

| | | |
|---|---|---|
| CN | 103538994 | 1/2014 |
| CN | 203545420 | 4/2014 |
| DE | 587732 | 11/1933 |
| JP | 0524774 | 2/1993 |

* cited by examiner

ADJUSTABLE INTERMEDIATE DISK BODY OF LARGE DOUBLE-LAYER CAGE AND ADJUSTING AND MOVING METHOD THEREOF

CROSS REFERENCE TO RELATED APPLICATION

The present application is a 371 U.S. National Stage of International Application No. PCT/CN2014/074087, filed March 26, 2014, which claims the benefit of the earlier filing date of Chinese Patent Application No. 201310453447.2 filed on Sep. 29, 2013, which are each incorporated herein by reference in their entirety.

FIELD OF THE INVENTION

The present invention relates to an adjustable intermediate disk body of large double-layer cage and an adjusting mid moving method thereof, which are especially suitable for integral transport of large-size equipment in lower layers of cages in mines.

BACKGROUND OF THE INVENTION

When large-size equipment is to be transported to the down-hole area in a mine, often the large-size equipment has to be disassembled into components, the components are transported to the down-hole area, and then the components are reassembled into the large-size equipment, because the space in the cage is inadequate; to attain the purpose of integral lifting, the cage has to he very large and heavy. Consequently, the workload is increased, and the maximum lifting capability of the lifting system per run is decreased. An adjustable disk body that can be used to increase the space in the cage by adjusting and moving the disk vertically is not available yet in the present large-size cage market.

SUMMARY OF THE INVENTION

Technical problem: To overcome the drawbacks in the prior art, the present invention provides an adjustable intermediate disk body of large double-layer cage, which is simple in structure, easy to use, and can be used to adjust the space in a cage, the present invention also provides an adjusting and moving method tor the adjustable intermediate disk body of large double-layer cage.

Technical scheme: The adjustable intermediate disk body of large double-layer cage in the present invention comprises cage columns, a main intermediate disk body arranged in the cage columns, and a chain block and a connecting piece connected to a cage suspension board, wherein, an intermediate disk guide rail beam for the main intermediate disk body to move up and down is arranged on the inner side of the cage columns, wedge bases designed to fix the descending position of the main intermediate disk body are arranged symmetrically on the two sides of the lower part of the intermediate disk guide rail beam, a limited block is arranged on the upper part of the intermediate disk guide rail beam, a bolt hole designed to fix the ascending position of the main intermediate disk body is arranged in the limited block; intermediate disk wedge bodies, which match the wedge faces of the wedge bases, are arranged on the two side faces of the main intermediate disk body, at positions corresponding to the intermediate disk guide rail beam, an intermediate disk guide wheel that is fitted with the intermediate disk guide rail beam and an intermediate disk guide wheel seat with a bolt hole are arranged on the upper part of the intermediate disk wedge body; an anti-disengaging plate is arranged on the intermediate disk guide rail beam.

An adjusting and moving method for the adjustable intermediate disk body of large double-layer cage described above, comprising:

After the large double-layer cage is docked at a level for transporting equipment into the cage, connecting the main intermediate disk body via the chain block and connecting piece, applying force in the forward direction to lift up the main intermediate disk body from the wedge bases and driving the main intermediate disk body to move upwards, and then the bolts are inserted into the bolt holes when the bolt holes of the intermediate disk guide wheel seats are aligned to the bolt holes of the limited blocks on the cage columns, to fix the main intermediate disk body at the level of the limited blocks;

After the large double-layer cage is docked at a level for transporting equipment out of the cage, connecting the main intermediate disk body via the chain block and connecting piece, applying force in the forward direction to release the load on the bolts, and then pulling out the bolts and applying force in the reversed direction, to lower the main intermediate disk body onto the wedge bases.

Beneficial effects: With the technical scheme described above, by arranging guide rails on the cage columns, the fixed intermediate disk body can be moved up and down along the guide rails, so that the space in the double-layer cage can be changed, the height of the cage can be adjusted according to the large-size equipment to be transported, so as to utilize the vertical space in a large double-layer cage and meet the requirement for integral transport of large-size equipment (e.g., a large-size hydraulic support) into the down-hole area. The adjustable intermediate disk body of large double-layer cage is compact in structure, easy to move and adjust, and has high practicability.

Among the Figures: 1—cage column, 2—main intermediate disk body, 3—bolt, 4—chain block and connecting piece, 5—cage suspension board, 1-1—intermediate disk guide rail beam, 1-2—wedge base, 1-3—anti-disengaging plate, 1-4—limited block, 2-1—intermediate disk wedge body, 2-2—intermediate disk guide wheel, 2-3—intermediate disk guide wheel seat.

DETAILED DESCRIPTION OF THE EMBODIMENTS

Figure 1:
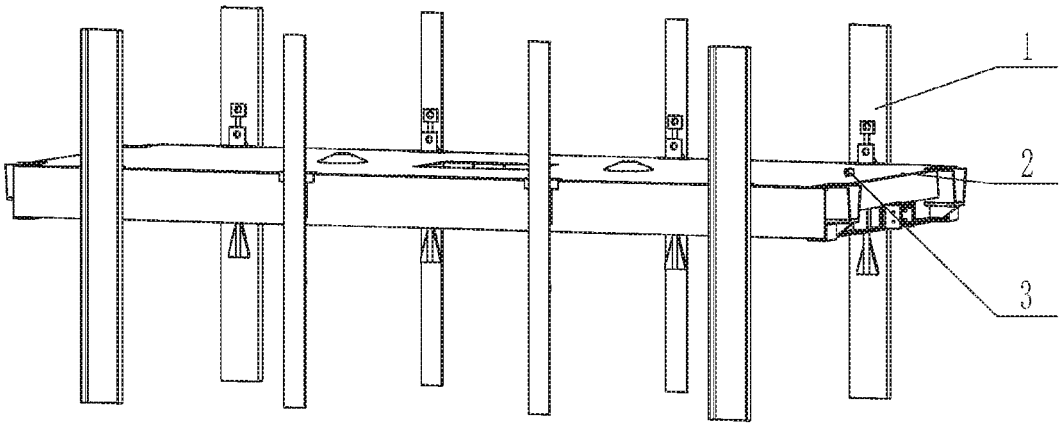
FIG. 1 is a schematic structural diagram of the adjustable intermediate disk body described in the present invention.

Hereunder the present invention will be further detailed in an embodiment, with reference to the accompanying drawings:

As shown in FIG. 1, the adjustable intermediate disk body of large double-layer cage provided in the present invention mainly consists of cage columns 1, a main intermediate disk body 2 arranged in the cage columns 1, and a chain block and a connecting piece 4 connected to a cage suspension board 5, wherein, the main intermediate disk body 2 is made of profile steels and steel plates by welding.

Figure 2:
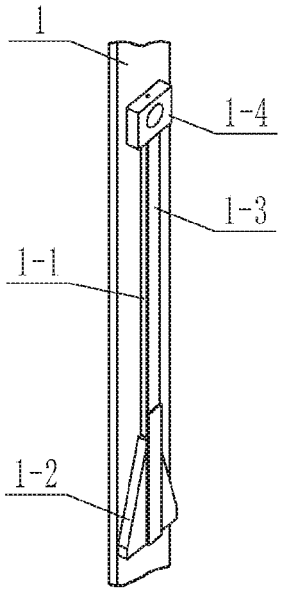
FIG. 2 a schematic structural diagram of the cage columns described in the present invention.

As shown in FIG. 2, an intermediate disk guide rail beam 1-1 for the main intermediate disk body 2 to move up and down is arranged on the inner side of the cage columns 1, wedge bases 1-2 designed to fix the descending position of the main intermediate disk body 2 are arranged symmetrically on the two sides of the lower part of the intermediate disk guide rail beam 1-1, a limited block 1-4 is arranged on the upper part of the intermediate disk guide rail beam 1-1, a bolt hole designed to fix the ascending position of the main intermediate disk body 2 is arranged in the limited block 1-4, and an anti-disengaging plate 1-3 is arranged on the intermediate disk guide rail beam 1-1.

Figure 3:
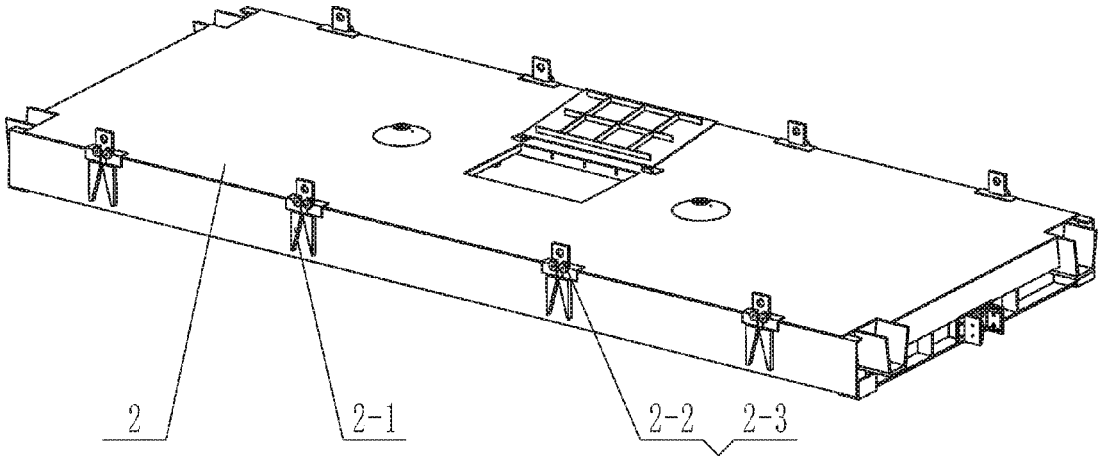
FIG. 3 is a schematic structural diagram of the main intermediate disk body described in the present invention.
Figure 4:
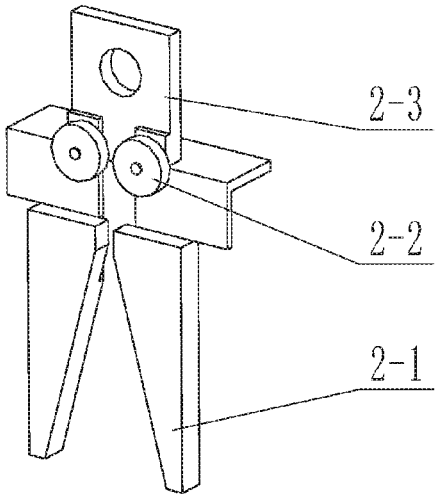
FIG. 4 is a schematic partial structural diagram of the main intermediate disk body described in the present invention.

As shown in FIG. 3 and FIG. 4, intermediate disk wedge bodies 2-1 that match the wedge faces of the wedged bases 1-2 are arranged on the two side faces of the main intermediate disk body 2, at positions corresponding to the intermediate disk guide rail beams 1-1; an intermediate disk guide wheel 2-2 that is fitted with the intermediate disk guide rail beam 1-1 and an intermediate disk guide wheel seat 2-3 with a bolt hole are arranged on the upper part of the intermediate disk wedged body 2-1; the intermediate disk wedge body 2-1 and intermediate disk guide wheel seat 2-3 can be fixed to the main intermediate disk body 2 with high strength bolts.

Figure 5:
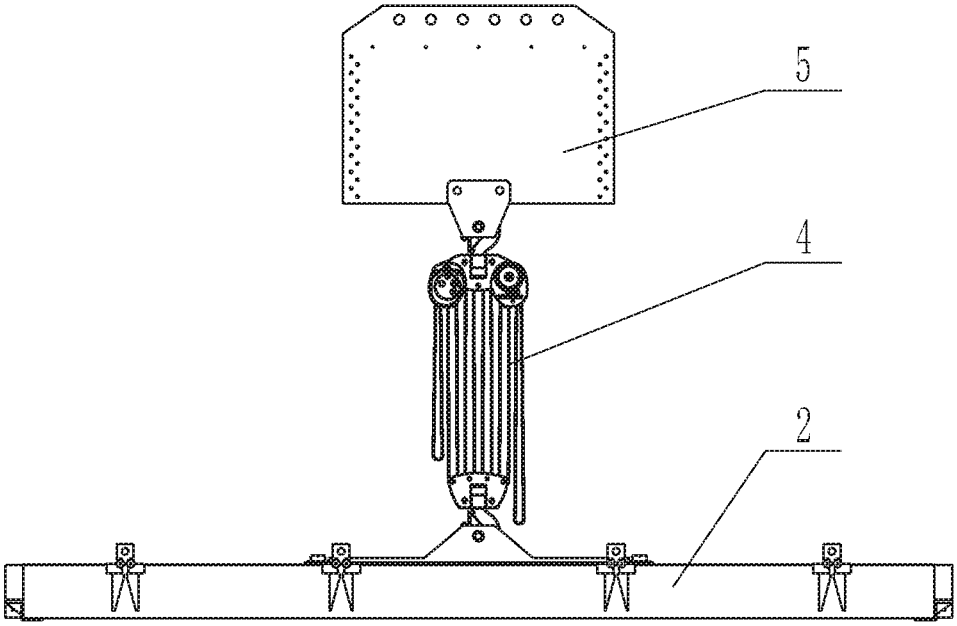
FIG. 5 is a schematic structural diagram of the connection for adjusting and moving the adjustable intermediate disk body described in the present invention.
Figure 6:
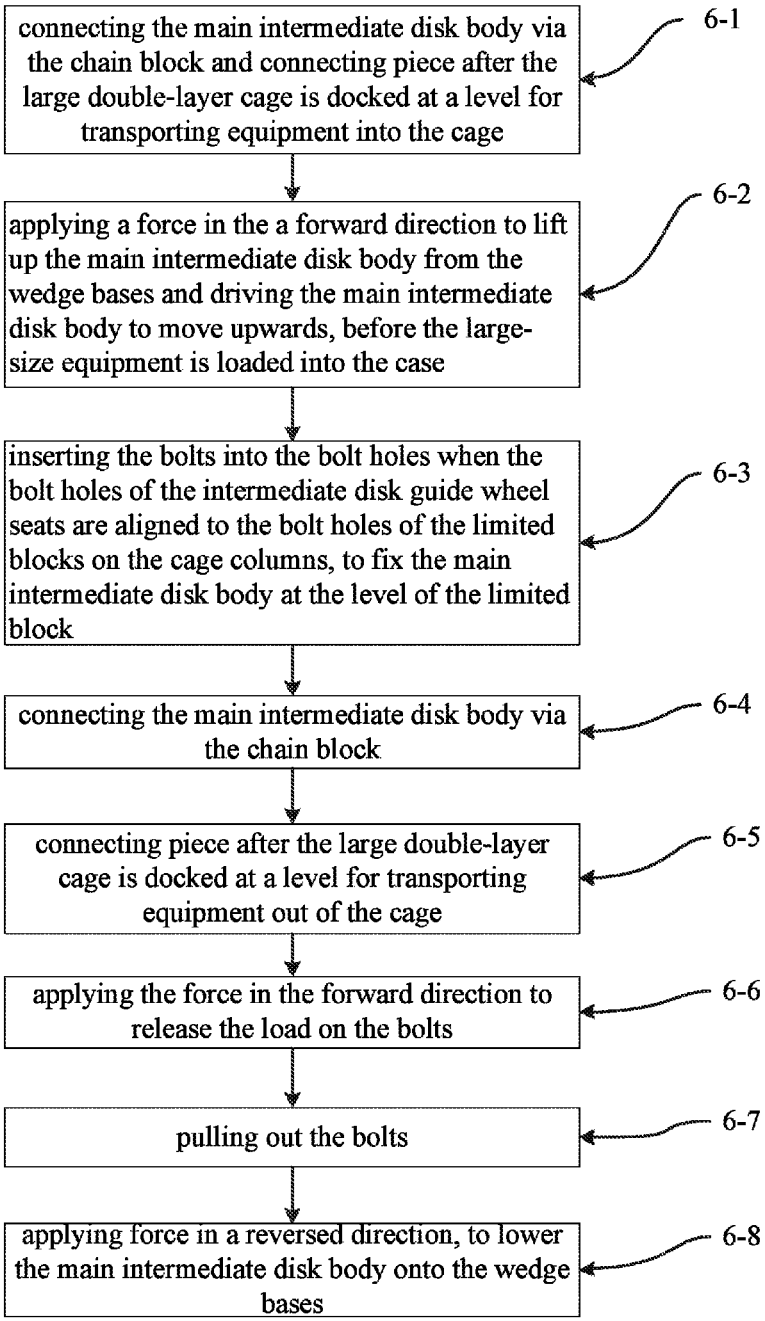
FIG. 6 is a flowchart showing the method of adjusting and moving the adjustable intermediate disk body of a large double-layer cage.

An adjusting and moving method for the adjustable intermediate disk body of large double-layer cage described above, as follows:

As shown in FIG. 5, after the large double-layer cage is docked at a level for transporting equipment into the cage, the chain block and connecting piece 4 are connected to the main intermediate disk body 2 before the large-size equipment is loaded into the case, then, force is applied in the forward direction via the chain block and connecting piece 4 connected to a cage suspension board 5 to lift up the main intermediate disk body 2 from the wedge bases 1-2 and drive the main intermediate disk body 2 to move upwards, and then the bolts 3 are inserted into the bolt holes when the bolt holes of the intermediate disk guide wheel seats 2-3 are aligned to the bolt holes of the limited blocks 1-4 on the cage columns 1, to fix the main intermediate disk body 2 at the level of the limited blocks;

After the large double-layer cage is docked at a level for transporting equipment out of the cage, chain block and connecting piece 4 are connected to the main intermediate disk body 2 after the equipment is transported out of the cage, then, force is applied in the forward direction via the chain block and connecting piece 4 connected to a cage suspension board 5 to release the load on the bolts 3, and then the bolts are pulled out and force is applied in the reversed direction, to lower the main intermediate disk body 2 onto the wedge bases 1-2. In addition, the upper-layer door of the cage is of rolling shutter type or removable, and the side walls near the main intermediate disk body 2 is movable with the main intermediate disk body 2, to avoid interfering with the adjustment and movement of the main intermediate disk body 2.

The invention claim is:

1. An adjustable intermediate disk body of large double-layer cage, comprising:

cage columns;

a main intermediate disk body arranged in between the cage columns; and a chain block and a connecting piece connected to a cage suspension board, wherein, an intermediate disk guide rail beam is arranged on an inner side of the cage columns and slidably connected to the main intermediate disk body operable to move up and down, wedge bases are arranged symmetrically on the two sides of a lower part of the intermediate disk guide rail beam and designed to fix a minimum descending position of the main intermediate disk body, each wedge base including a wedge face, a limited block is arranged on an upper part of the intermediate disk guide rail beam, a first bolt hole is arranged on the limited block and is designed to fix a maximum ascending position of the main intermediate disk body;

intermediate disk wedge bodies are arranged on two side faces of the main intermediate disk body at a position aligning with and at least partiailly on either side of each of the intermediate disk guide rail beams, which are shaped to inversely correspond to the shape of the wedge faces of the wedge bases; and at least one intermediate disk guide wheel rotably connected to the intermediate disk wedge body that is operably connected to the intermediate disk guide rail beam to enable the main intermediate disk body to translate with respect to the intermediate disk guide rail beam; and at least one intermediate disk guide wheel seat with a second bolt hole is positioned on an upper part of the intermediate disk wedge body.

2. The adjustable intermediate disk body of large double-layer cage according to claim 1, wherein, an anti-disengaging plate is arranged on the intermediate disk guide rail beam.

3. An adjusting and moving method for the adjustable intermediate disk body of large double-layer cage according to claim 1, comprising:

connecting the main intermediate disk body via the chain block and connecting piece after the large double-layer cage is docked at a level for transporting equipment into the cage;

applying a first force in a forward direction to lift up the main intermediate disk body from the wedge bases and driving the main intermediate disk body to move upwards, and inserting the bolts into the bolt holes when the bolt holes of the intermediate disk guide wheel seats are aligned to the bolt holes of the limited blocks on the cage columns, to fix the main intermediate disk body at the level of the limited blocks; and connecting the main intermediate disk body via the chain block and connecting piece after the large double-layer cage is docked at a level for transporting equipment out of the cage, applying second force in the forward direction to release the load on the bolts, and pulling out the bolts and applying a third force in a reversed direction, to lower the main intermediate disk body onto the wedge bases.

* * * * *